United States Patent [19]

Matsui et al.

[11] 4,200,389

[45] Apr. 29, 1980

[54] PRESSURE FIXING APPARATUS FOR COPIER

[75] Inventors: Toshio Matsui; Yasuhiko Doi; Yasuo Nakamura, all of Toyokawa, Japan

[73] Assignee: Minolta Camera Kabushiki Kaisha, Sakai, Japan

[21] Appl. No.: 905,459

[22] Filed: May 12, 1978

[30] Foreign Application Priority Data

Dec. 12, 1977 [JP] Japan ..... 52-160026

[51] Int. Cl.[2] ..... G03G 15/00

[52] U.S. Cl. ..... 355/3 FU; 100/158 R; 100/176; 29/121.8; 219/469; 432/60

[58] Field of Search ..... 100/93 RP, 176, 158; 29/121.8, 132; 432/60, 228; 219/216, 469–471; 355/3 FU; 101/216, 23; 51/319

[56] References Cited

U.S. PATENT DOCUMENTS

| | | | |
|---|---|---|---|
| 2,114,072 | 4/1938 | Cleveland | 29/121.8 |
| 3,196,788 | 7/1965 | Knowles | 101/216 X |
| 3,309,984 | 3/1967 | MacKay | 101/23 X |
| 3,595,539 | 7/1971 | Kimura et al. | 100/93 RP |
| 3,841,963 | 10/1974 | Schlunke | 100/93 RP |
| 3,924,313 | 12/1975 | Broderick | 29/121.8 |
| 3,982,094 | 9/1976 | Kratcoski et al. | 219/216 |

FOREIGN PATENT DOCUMENTS

| | | | |
|---|---|---|---|
| 52-129525 | 10/1977 | Japan | 100/176 |

*Primary Examiner*—Peter Feldman

*Attorney, Agent, or Firm*—Watson, Cole, Grindle & Watson

[57] ABSTRACT

A pressure fixing apparatus in which copying paper with unfixed toner images formed on one surface is passed between a pair of press rollers in pressing contact with each other to fix the toner images to the copying paper with the pressure of the rollers. At least one of the rollers which comes into contact with the toner images on the copying paper has a roughened surface formed of minute round-edged projections.

6 Claims, 37 Drawing Figures

PRESSURE FIXING APPARATUS FOR COPIER

BACKGROUND OF THE INVENTION

The present invention relates to a pressure fixing apparatus for fixing toner images onto copying paper after the tone images have been formed on the copying paper, e.g., after either the electrostatic latent images produced directly on a copying paper have been developed with toner, or after electrostatic latent images initially produced on a photoconductive member of an electrophotographic copying apparatus have been transferred to a copying paper and then treated with toner. More particularly, the present invention relates to a pressure fixing apparatus in which copying paper with such toner images formed on the surface thereof is passed between a pair of press rollers which are in pressing contact with each other to fix the toner images to the copying paper by pressure exerted by the rollers.

Generally speaking, pressure fixing apparatus are advantageous over heat fixing apparatus because they are usable immediately after the electrophotographic copying apparatus (or like mechanical apparatus incorporating the fixing apparatus) is initiated into operation, whereas heat fixing apparatus require a warm up waiting time of several minutes. Moreover, pressure fixing apparatus have the advantage of being free of fire hazards when the fixing unit is jammed with paper or when some other malfunction occurs.

Pressure fixing apparatus have therefore been widely used especially in electrophotographic copying apparatus. The press rollers used in such known fixing apparatus are produced, for example, by first subjecting the surface of a steel roller to induction hardening, then coating the surface with a hard chromium plating and finally polishing the plating to a specular surface of about 0.5 S, i.e., so as to render the press roller free from any offset when brought into contact with the toner image under high pressure. However, the pressure applied by the specular roller surface to the toner images imparts a high gloss to the fixed images, such that the images have a very poor visibility when seen at certain angles. Additionally, such a glossy copy is not desirable to many people. Thus, the gloss attendant on pressure fixing operation is the most serious drawback of the known apparatus of this type.

To overcome the problem of gloss, it is known to utilize a heater subsequent to the pressure fixing apparatus, such that the toner images fixed by the apparatus are heated and thereby made glossless (see, for example, Japanese Laid-Open Patent Application No. Sho 52-78441 and Japanese Laid-Open Utility Model Application No. Sho 52-63045). Although the heater useful for this purpose may be of smaller capacity than those adapted for the heat fixing of toner images, the use of the heater, as in heat fixing, renders the copying apparatus complex and expensive and involves fire hazards. Furthermore, the user must wait for some time for the warming-up of the heater after closing the main switch. These drawbacks nullify the advantages of such pressure fixing apparatus when substituted for the heat fixing apparatus.

In an attempt to overcome the foregoing drawbacks inherent in the matting of toner images by heating, especially to eliminate the necessity for the waiting time, another apparatus has been proposed which incorporates a rough-surfaced roller disposed subsequent to the pressure fixing apparatus for matting the fixed toner images (see Japanese Laid-Open Patent Application No. Sho 52-129525). However, the matting means provided for the pressure fixing apparatus similarly makes the copying apparatus complex and expensive. In addition, the matting roller, although adapted to act on the toner image after fixing, still involves the problem of offset, i.e., because the smooth glossy face of the image is roughened with the uneven roller surface. The rough roller surface is further subject to losing its matting function due to being smoothened by the pressing and frictional contact with the opposed roller surface. Thus such a proposed apparatus is not practical because of the problems encountered with respect to offset, cleaning of the roller and durability.

An object of the present invention therefore is to provide a pressure fixing apparatus capable of producing glossless or mat-fixed toner images without the necessity of using any special means for matting the fixed images.

Another object of the present invention is to provide a pressure fixing apparatus for producing glossless, fixed toner images without entailing any offset.

Another object of the present invention is to provide a pressure fixing apparatus including press rollers which can be cleaned with ease so as to be free from offset.

Still another object of the present invention is to provide a pressure fixing apparatus which is capable of giving glossless fixed toner images over a prolonged period of time free of any trouble.

SUMMARY OF THE INVENTION

According to the present invention an improved pressure fixing apparatus for toner images comprises opposed press rollers wherein at least one roller has a roughened surface formed of minute round-edged projections which are adapted to fix toner images by pressure while producing a matting effect on the resulting images without involving any offset or creating other problems heretofore encountered.

Press rollers having roughened surfaces formed by the usual blasting process, although capable of producing mat images, have difficulty in preventing offset and are generally not usable for pressure fixing rollers; however, when the roughened surface is defined by minute round-edged projections, the surface has been found to give the desired matting effect without giving rise to offset.

The invention will now be better understood with reference to the following description when taken together with the accompanying drawings.

DESCRIPTION OF THE PREFERRED EMBODIMENT

Figure 1:
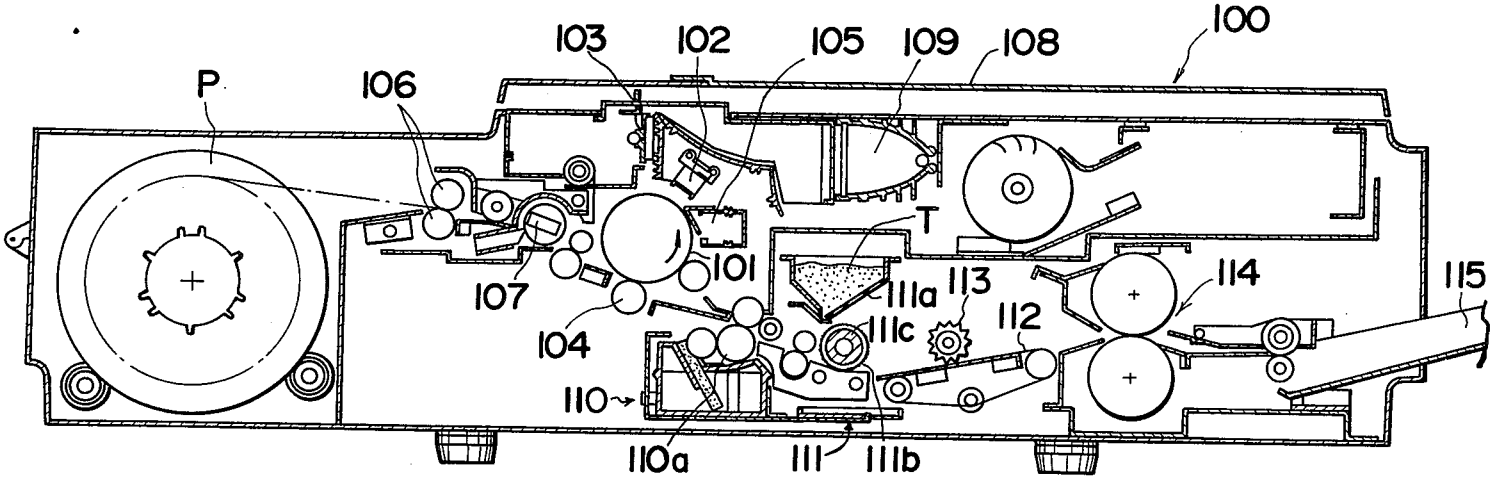
FIG. 1 shows a sectional view of an electrophotographic copying apparatus incorporating a pressure fixing apparatus according to the present invention.

The construction and operation of the electrophotographic copying apparatus 100 shown in FIG. 1 will be described first.

The apparatus includes a photoconductive drum 101 which is rotatable in a connterclockwise direction and is surrounded by a charger 102, an exposure lens unit 103, a roller 104 for transferring latent images, a charge removing eraser 105, etc., as arranged in the order mentioned.

A roll of copying paper P has a leading end nipped between a pair of feed rollers 106, which when rotated by a suitable drive means in response to a drive signal, pass the paper P forward. The paper is cut to a suitable length by a cutter 107. The electrostatic latent images formed on the photoconductive drum 101 are transferred by the transfer roller 104 onto the cut-off sheet of paper.

The method of forming electrostatic latent images on the photoconductive drum 101 is already well known and will not be described in detail. Briefly stated, latent images are formed by uniformly charging the surface of the drum 101 by the charger 102 while the drum is in rotation and causing an exposure lamp 109 to illuminate an original (not shown) on a carriage 108 driven leftward in the drawing in timed relation to the photoconductive drum 101 while exposing the drum 101 to the reflected light through the lens unit 103. The copying paper P is composed essentially of a conductive layer and an insulating layer. The insulating layer is brought into proximity to or pressing contact with the surface of the photoconductive drum 101 for the transfer of the latent images thereto.

The copying paper P with the latent images transferred thereto is separated from the photoconductive surface, passed through a water adding-unit 110 and then through a developing unit 111 in which the latent images are converted to visible images with a toner. The paper is thereafter sent into a pressure fixing apparatus 114 by a conveyor belt 112, a retaining wheel 113, etc. The paper bearing the fixed images thereon is sent out onto a tray 115 on completion of the copying operation.

The water-adding unit 110 used for maintaining the rear conductive layer of the copying paper P at an increased and constant conductivity includes a roller 110*a* to which water is always applied at a substantially constant rate.

In the developing unit 111, a magnetic developer T contained in a toner tank 111*a* is applied to a sleeve 111*b* and retained thereon by a magnet 111*c*. The toner is deposited on the electrostatic latent images on the copying paper P transported by the rotation of the magnet 111*c* and/or the sleeve 111*b*.

Figure 2:
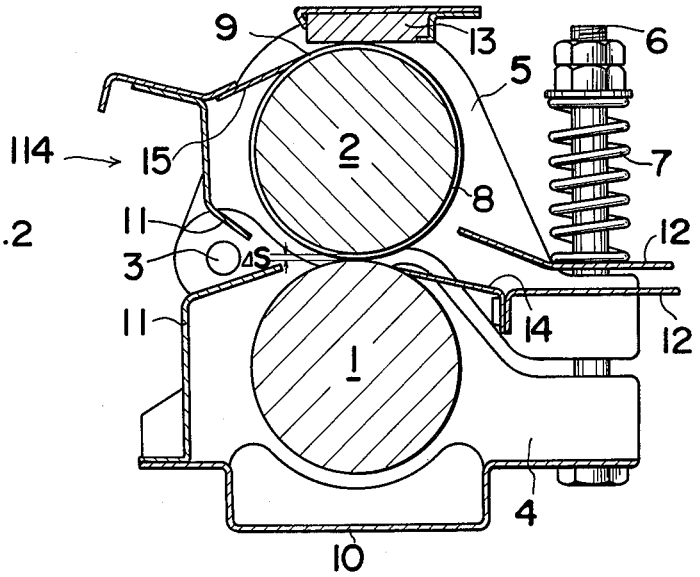
FIGS. 2 to 4 represent views illustrating the pressure fixing apparatus of the present invention.
Figure 3A:
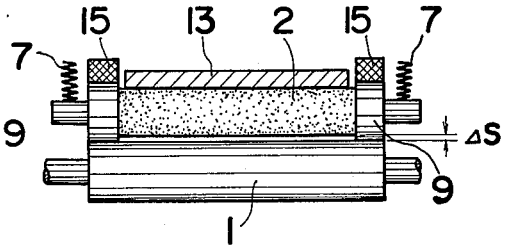
Figure 3B:
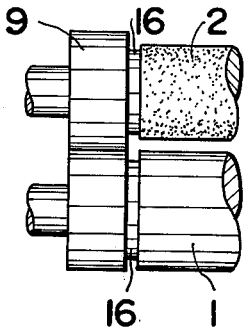
Figure 4:
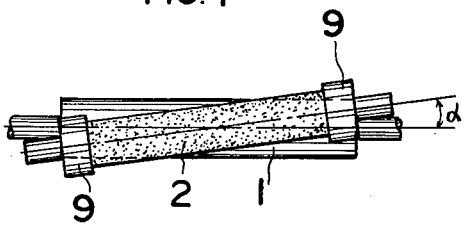

With reference to FIGS. 2, 3 and 4, an embodiment of the pressure fixing apparatus 114 of this invention will be described below. A pair of press rollers 1 and 2, disposed one above the other, are individually supported at each end thereof, the lower roller 1 at each end by a separate lower fixed bearing member 4 and the upper roller 2 at each end by a separate upper movable bearing member 5. Each adjacent upper and lower bearing member is connected together at the paper input end of the apparatus 114 by a separate support rod 3 and at the paper outlet end by separate bolts 6. Springs 7 mounted on the bolts 6 push the bearing members 5 toward the bearing members 4, thereby forcing the upper roller 2 into pressing contact with the lower roller 1. When a copying sheet bearing unfixed toner images thereon is fed to the rollers, the rollers fix the images by exerting pressure thereon as the sheet is passed therebetween by the rotation thereof.

This invention is characterized in that one of the press rollers 1 and 2, e.g., the roller 2, which is to be brought into contact with the unfixed toner images on the copying sheet has a roughened surface as at 8, is composed of minute round-edged projections. Copying sheets are usually fed to the press rollers with the unfixed toner images on the upper surface of the sheet but, otherwise, the roller 1 will have a rough surface 8. Further, with double-faced copying sheets, one of the press rollers 1 and 2 will come into contact with the unfixed toner images, while the other roller will contact the fixed toner images previously formed. Consequently the latter roller will render the fixed images glossy when having a specular surface or is prone to offset if merely rough-surfaced to mat the images. For use with double-faced copying sheets, therefore, both the rollers 1 and 2 should be rough-surfaced according to this invention.

When the toner images on the copying sheet are fixed by the pressure of the press rollers 1 and 2, the minute projections on the rough surface 8 of the roller 2 are impressed on the copy surface bearing the toner images, thereby producing a mat surface of fine texture. The overall copy surface including the fixed toner images will then diffusedly reflect the interior or outdoor rays impinging thereon, thus assuming a glossless dull appearance and rendering the images readily visible without causing fatigue to the eye.

To enable the press rollers 1 and 2 to give a sufficient line pressure when fixing toner images, the rollers are usually subjected to a high pressure of about 20 kg/cm to about 60 kg/cm, which, however, is likely to deflect the rollers, with the resulting tendency that the rollers are unable to exert a uniform line pressure over the entire length thereof. This produces an increased pressure at the opposite ends and a reduced pressure at the midportion of the rolls. This would normally lead to uneven fixing of toner images or make a crease in the copying sheet. To avoid this problem, the press rollers 1 and 2 are either positioned with their axes intersecting each other or else the rollers are crowned so that the rollers will have a progressively decreasing diameter moving from the center toward the opposite ends. As seen in FIG. 4, the rollers 1 and 2 of the present embodiment are so arranged that their axes intersect each other at an angle $\alpha$ and thereby are adapted to produce a uniform fixing pressure and concurrently prevent the copying sheet from creasing. The roller 2 has at each of its opposite ends a diametrically enlarged portion 9 providing a recess for forming a clearance $\Delta S$ between the rollers 1 and 2 (FIG. 3*a*). The clearance $\Delta S$ extends over the effective copying range for the copying sheet and is not larger than the thickness of the sheet. Because of these features, the copying sheet, when passed between the rollers, can be subjected to a substantially uniform pressure over the entire width of the sheet, whereby the toner images thereon can be uniformly fixed. In the absence of the copying sheet between the rollers, the clearance $\Delta S$ keeps the rough surface 8 out of contact with the surface of the roller 1, thereby permitting the minute projections of the rough surface 8 to remain free of abrasion or pressure and retain the desired matting ability over a prolonged period of time.

The provision of the diametrically enlarged portions 9 is also advantageous in eliminating the impact which otherwise would act on the bearings or other parts of the press rollers 1 and 2 upon the ingress of an advancing copying sheet P into the nip of the rollers, in subjecting the sheet to a uniform pressure over the entire width thereof for satisfactory fixing operation while the sheet is being passed between the rollers, and in precluding the creasing of the copying sheet.

During the absence of the copying sheet P between the press rollers 1 and 2, the enlarged portions 9 are held pressed against the roller 1 under an exceedingly high pressure. To avoid the possible wear which would result from a long period of use, each enlarged portion 9 is provided in contact therewith with a lubricant applicator 15 made of soft material such as polyurethane foam or felt and impregnated with a grease having a consistency of about 300. Usually the press rollers 1 and 2 are driven at a speed of 10 r.p.m. to 50 r.p.m. and operated at room temperature (about 10° C. to about 30° C.), with the enlarged portions 9 subjected to pressure as high as 50 kg/mm to 150 kg/mm. In view of these conditions, a grease or highly viscous oil is preferable to use as the lubricant.

With reference to FIG. 3*b* which shows the enlarged portion 9 in FIG. 3*a* on an enlarged scale, the press rollers 1 and 2 are provided, each at each end portion thereof, with a groove 16 for preventing the lubricant from flowing over the pressing roller surface. This is preferable for keeping the copying sheet P free from the lubricant.

The enlarged portions 9 for providing the clearance $\Delta S$ may be formed on the lower roller 1 or on both rollers 1 and 2. Indicated at 10 is a frame plate, at 11 a sheet feed guide, at 12 sheet discharge guide, at 13 a cleaner impregnated with silicone oil, and at 14 or 15 a blade.

Figure 5:
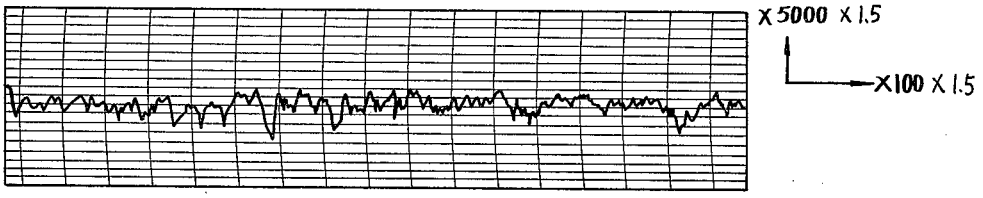
FIGS. 5 to 9 are enlarged diagrams illustrating projections on press roller surfaces with the magnifications indicated.
Figure 6:
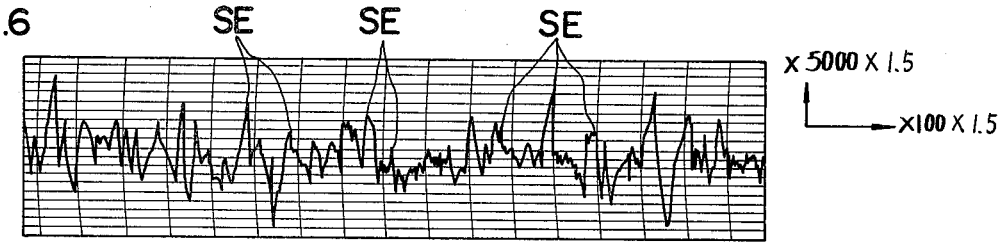
Figure 7:
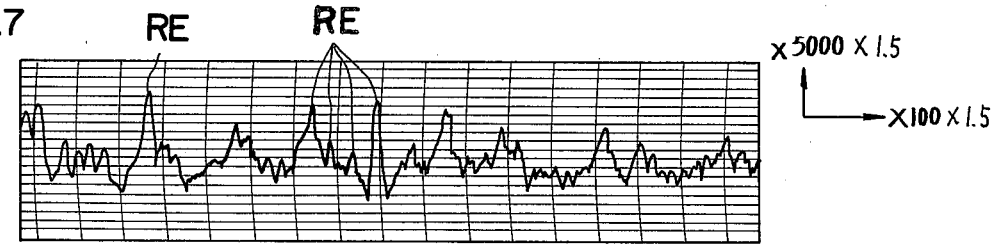
Figure 8:
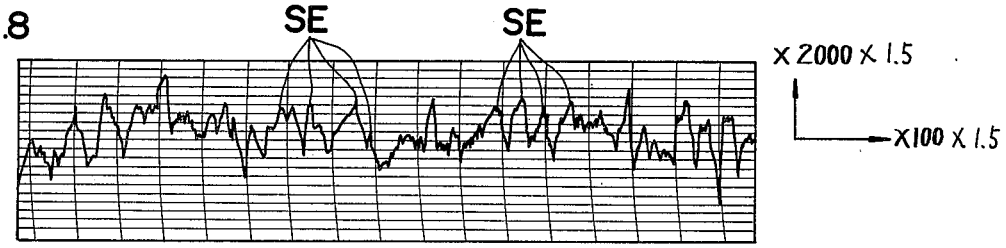
Figure 9:
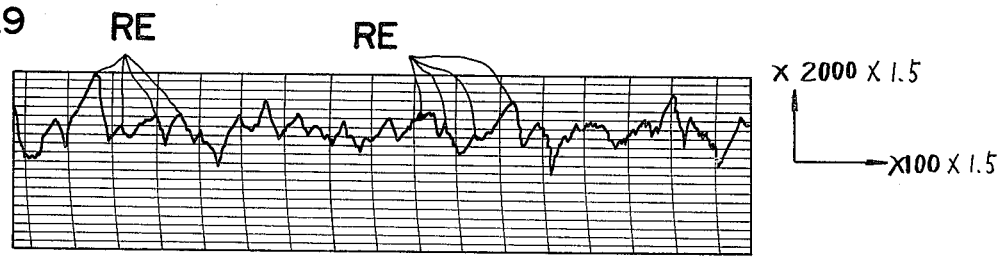
Figure 10:
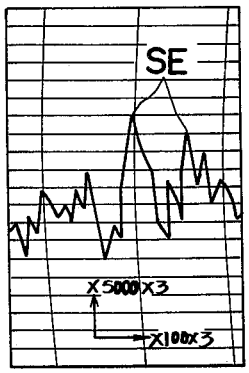
FIGS. 10 to 13 are diagrams corresponding to FIGS. 5 to 9, respectively, showing the same on a further enlarged scale.
Figure 11:
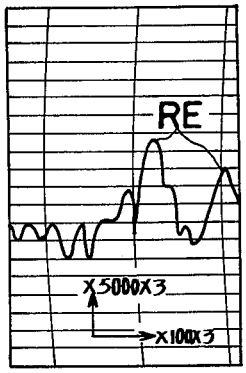
Figure 12:
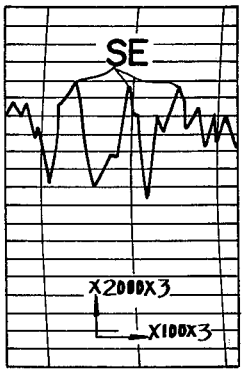
Figure 13:
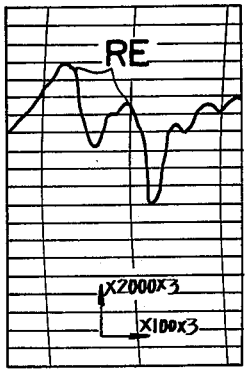
Figure 14:
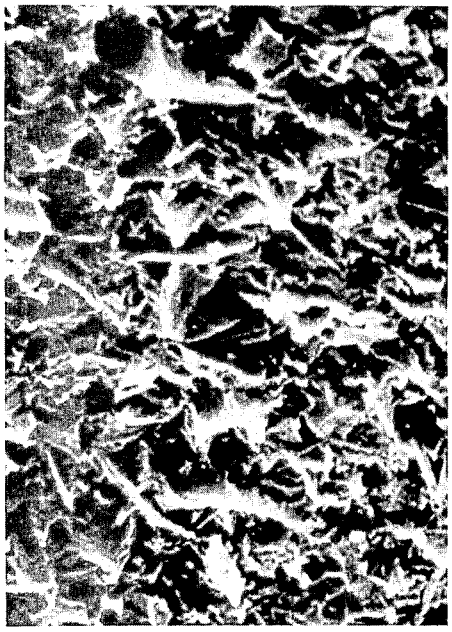
FIGS. 14 and 14*a* represent photomicrographs of the surface of a roller which has been sand blasted with sand abrasive No. 500 at magnifications of 1500 and 500, respectively.
Figure 14A:
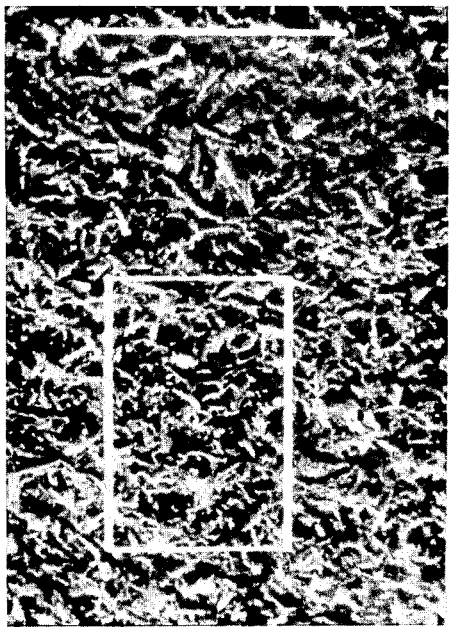
Figure 15:
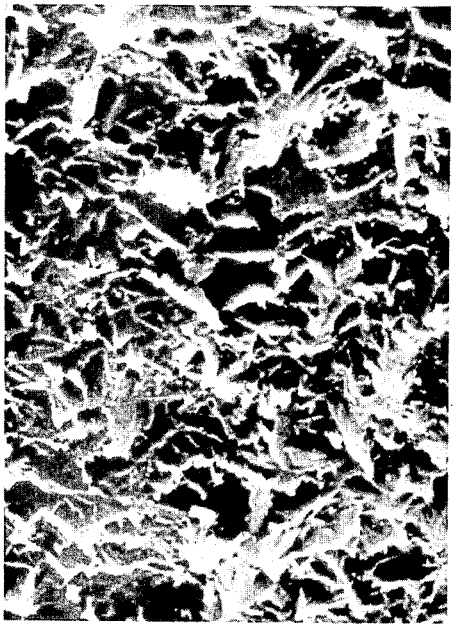
FIGS. 15 and 15*a* represent photomicrographs of the surface of a roller which has been sand blasted with sand abrasive No. 400 at magnifications of 1500 and 500, respectively.
Figure 15A:
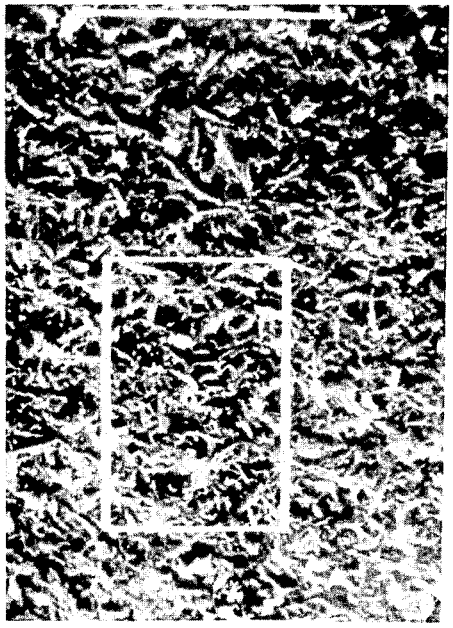
Figure 16:
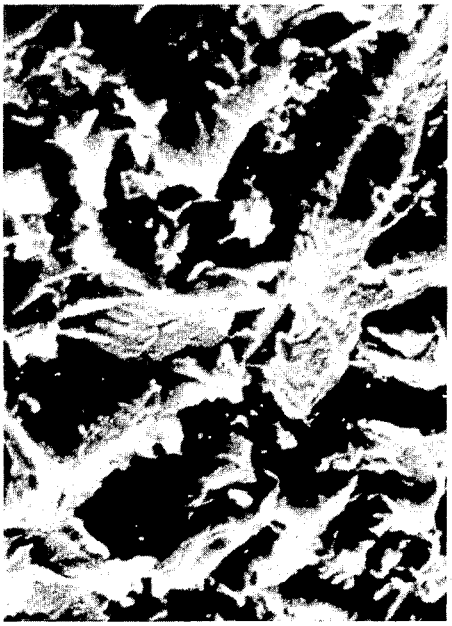
FIG. 16 and 16*a* represent photomicrographs of the surface of a roller which has been sand blasted with sand abrasive No. 320 at magnifications of 1500 and 500, respectively.
Figure 16A:
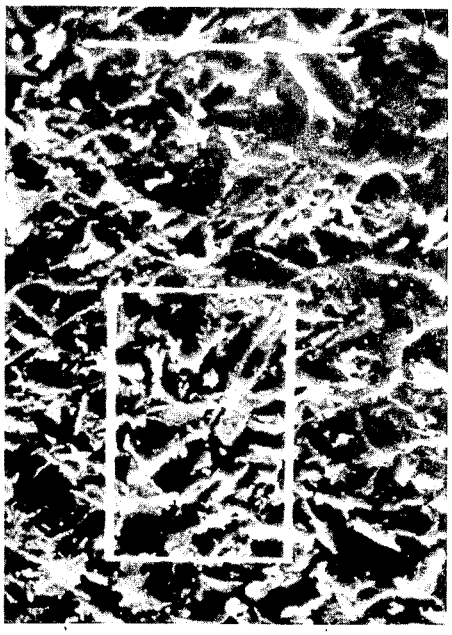
Figure 17:
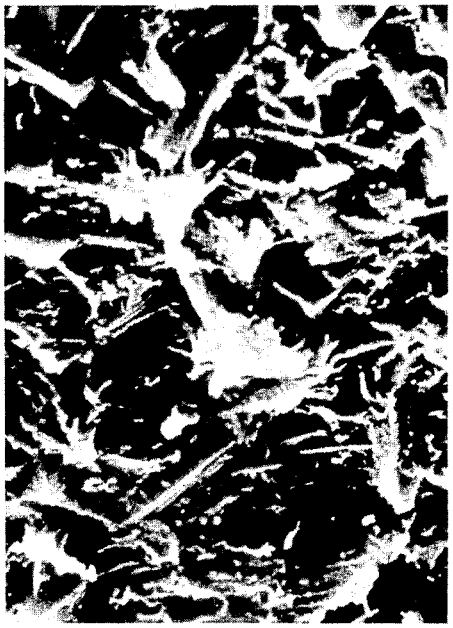
FIGS. 17 and 17*a* represent photomicrographs of the surface of a roller which has been sand blasted with sand abrasive No. 180 at magnifications of 1500 and 500, respectively.
Figure 17A:
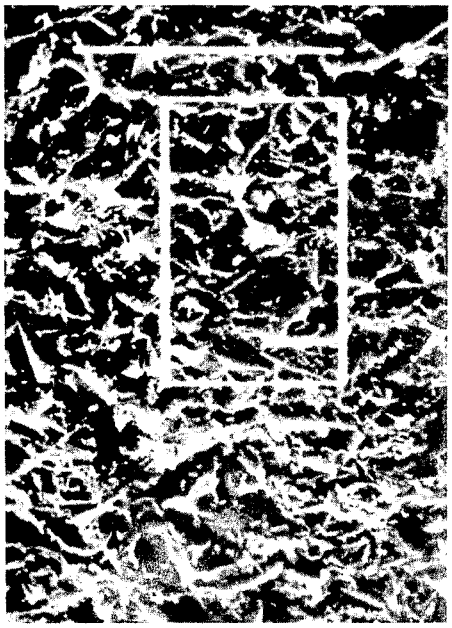
Figure 18:
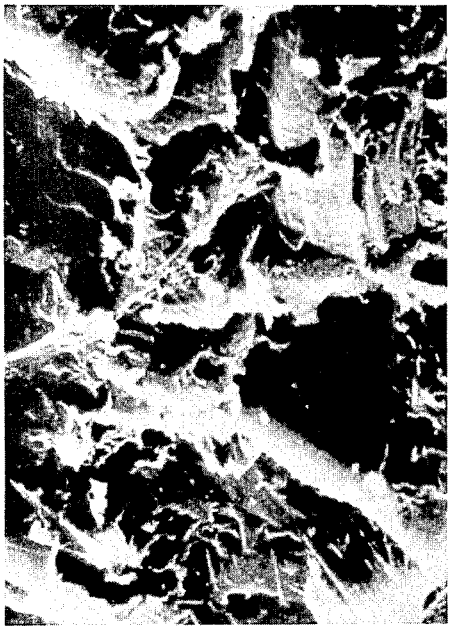
FIGS. 18 and 18*a* represent photomicrographs of the surface of a roller which has been sand blasted with sand abrasive No. 120 at magnifications of 1500 and 500, respectively.
Figure 18A:
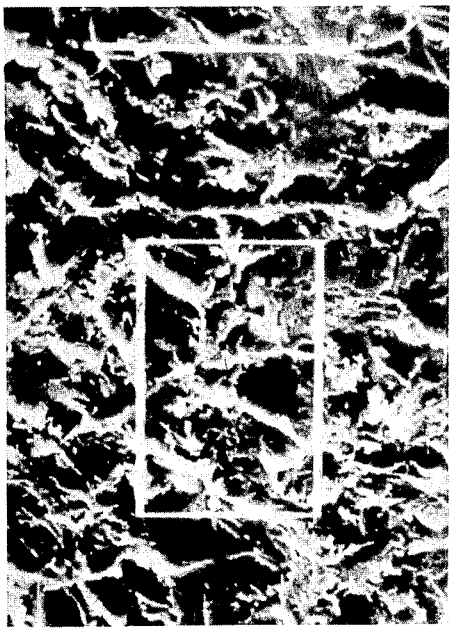
Figure 19:
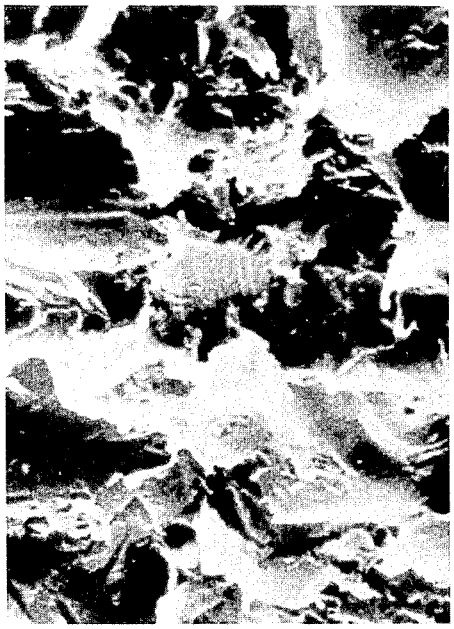
FIGS. 19 and 19*a* represent photomicrographs of the surface of a roller which has been sand blasted with sand abrasive No. 60 at magnifications of 1500 and 500, respectively.
Figure 19A:
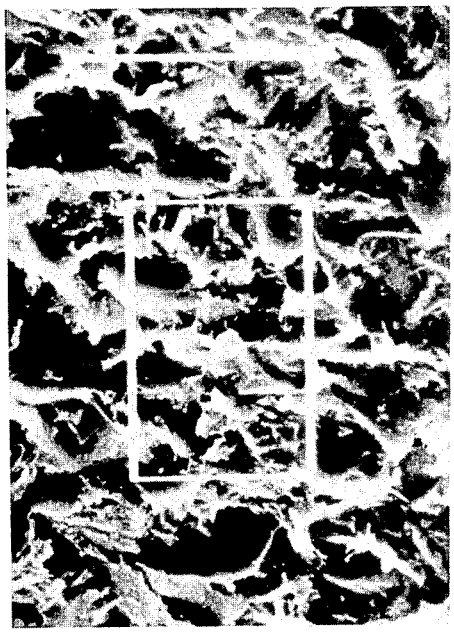

Press rollers herefore used have been prepared from steel rollers by hardening the surface of the roller to Rockwell Hardness C 60 or higher by induction hardening, plating the roller with chromium to render the surface resistant to corrosion, and pressure and polishing the plating to a specular finish of about 0.5 S to prevent the offset of the toner. We conducted an experiment with use of the same press rollers as above with the only exception being that the plated roller surface was polished to a rough finish. As a result, streaks produced by abrasive particles in the roller surface were reproduced on the copy surface, rendering the toner images unsightly, while offset was observed to take place which was very difficult to remove by cleaning. Conventional rollers polished to a mirror finish as above (polished to Rz (Ten Points Height, surface roughness) of 0.15$\mu$, following induction hardening; see FIG. 5) were also subjected to the usual sand blasting process and made rough-surfaced (to Rz 0.38 with No. 320 abrasive as illustrated in FIG. 6, or to Rz 0.90 with No. 180 abrasive as seen in FIG. 8). The use of such rollers resulted in a uniform reduction in gloss but still entailed offset which produced smudges on the copy surface obtained. The occurrence of offset appeared to be attributable to the fact that the minute projections on the rough roller surface, which are sharp-edged as indicated at SE in FIG. 6 (FIG. 10) and FIG. 8 (FIG. 12), engaged toner particles and retain the particles thereon despite cleaning. Accordingly, we plated the blasted surfaces, as shown in FIG. 6 (FIG. 10) and FIG. 8 (FIG. 12), with chromium to a thickness of 10$\mu$ to 15$\mu$. FIG. 7 (FIG. 11) shows the surface prepared from the blasted surface given in FIG. 6 (FIG. 10), and FIG. 9 (FIG. 13) shows the plated surface obtained from the blasted surface in FIG. 8 (FIG. 12). It is seen that the plated surfaces have minute projections with round edges RE. The rollers thus finished were found usable and free of any offset, giving copies with satisfactory images of greatly reduced gloss. The rough surface shown in FIG. 7 (FIG. 11) has Rz of 0.35$\mu$, and that shown in FIG. 9 (FIG. 13) has Rz of 0.85$\mu$.

The abrasives used for the sand blasting were emery, carborundum, alumina and iron particles, etc., each of which achieved good results. The table given below shows the relation between the particle size of the abrasive and the gloss of the fixed toner image. The table reveals that the gloss decreases with an increase in the particle size of the abrasive. The gloss (Gs (75°)) was determined in accordance with test for 75° Specular Gloss of Paper as described in ASTM D 1223-52T.

| Roller surface finish | Surface roughness | Gs (75°) (%) |
|---|---|---|
| Sand blasting with No. 60 abrasive, followed by chromium plating | 8.0 S | 6 |
| Sand blasting with No. 120 abrasive, followed by chromium plating | 5.0 S | 8 |
| Sand blasting with No. 180 abrasive, followed by chromium plating | 4.0 S | 15 |
| Sand blasting with No. 250 abrasive, followed by chromium plating | 2.5 S | 25 |
| Sand blasting with No. 320 abrasive, followed by chromium plating | 2.0 S | 34 |
| Sand blasting with No. 400 abrasive, followed by chromium plating | 1.3 S | 47 |
| Sand blasting with No. 500 abrasive, followed by chromium plating | 1.2 S | 48 |
| Conventional specular polish | 0.4 S | 53 |

Copies are acceptable for use when the Gs (75°) is the gloss value listed above. Further, with the increase in the particle size of the abrasive used for sand blasting, the gloss appears to decrease, but increasing difficulty will arise in fixing toner images. Accordingly, preferable abrasive particle sizes are generally in the range of No. 120 to No. 400. Preferably, the plating has a thickness of about 5μ to about 50μ. The plating should have a thickness of at least 5μ so as to be serviceable as a protective layer. With the thickness exceeding 50μ, the plating per se will produce surface irregularities, hence is objectionable.

This invention can be practiced with any blasting treatment and is not limited to sand blasting which provides one type of blast finish.

The plating is not limited to chromium plating; however, chromium plating is the most preferable in view of surface hardness and is effective in avoiding offset (because the toner is readily releasable from chromium plating). This enables the cleaner 13 shown in FIG. 3*a* to remove the toner with extreme ease, assuring production of copies of good quality.

EXAMPLE

The same apparatus as illustrated was used. The press rollers 1 and 2 were 61.6 mm in diameter and 300 mm in entire length (280 mm in effective length). A load of 380 kg was applied to each end of the recessed roller 2 by the spring 7. The rollers 1 and 2 were arranged to give a line pressure of 27 kg/cm, with the angle of intersection, α, set at 1.0° and the clearance ΔS at about 50μ to about 60μ. With the rough surface of the roller 2 adapted to give a gloss value of 15% to 34% as in the foregoing experiment, good results were achieved. The copy sheets used were 70μ to 80μ in thickness.

Figure 20:
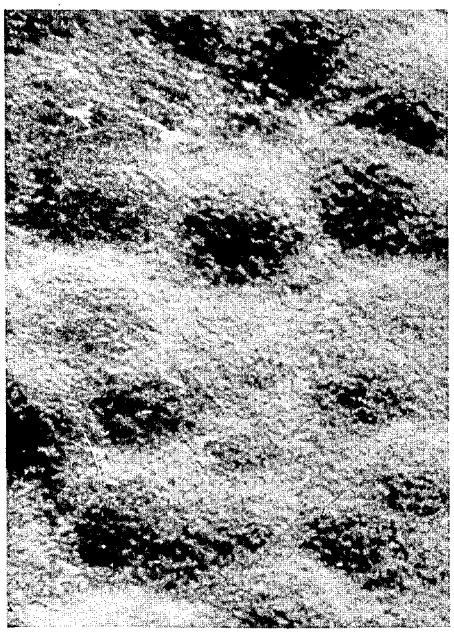
FIGS. 20 and 20*a* represent photomicrographs of the surface of a roller which has been sand blasted with sand abrasive No. 500 and then plated with chromium to a depth of between about 20μ to 25μ at magnifications of 1500 and 500, respectively.
Figure 20A:
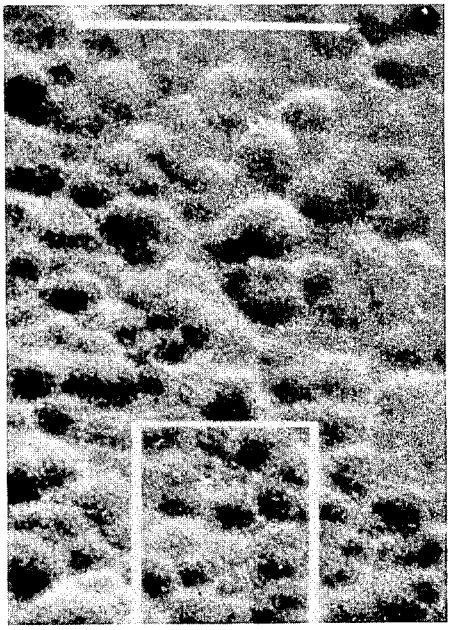
Figure 21:
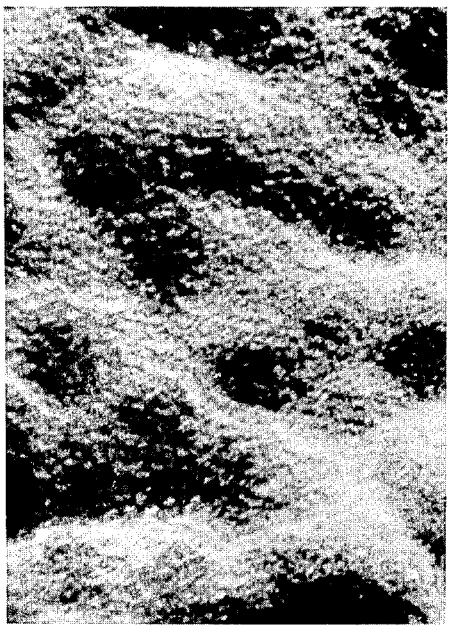
FIGS. 21 and 21*a* represent photomicrographs of the surface of a roller which has been sand blasted with sand abrasive No. 400 and then plated with chromium to a depth of between about 20μ to 25μ at magnifications of 1500 and 500, respectively.
Figure 21A:
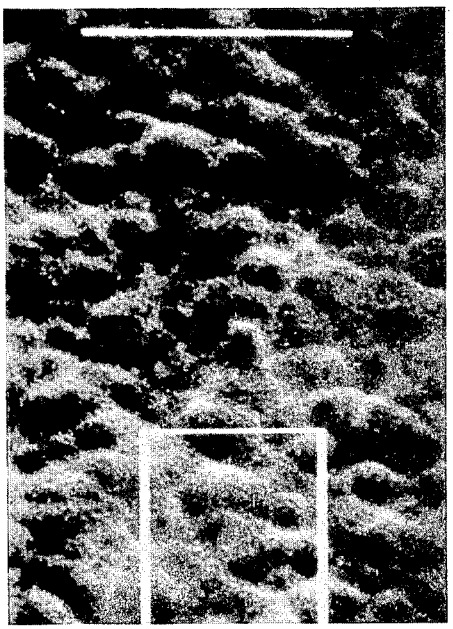
Figure 22:
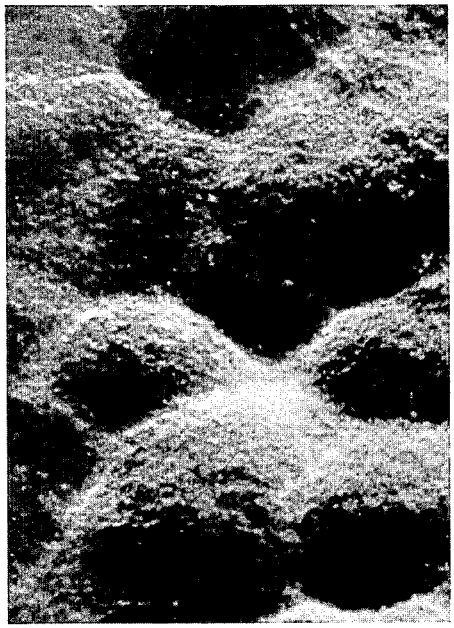
FIGS. 22 and 22*a* represent photomicrographs of the surface of a roller which has been sand blasted with sand abrasive No. 320 and then plated with chromium to a depth of between about 20μ to 25μ at magnifications of 1500 to 500, respectively.
Figure 22A:
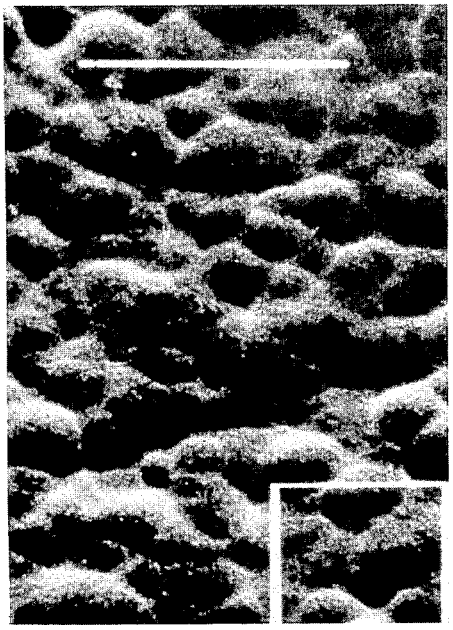
Figure 23:
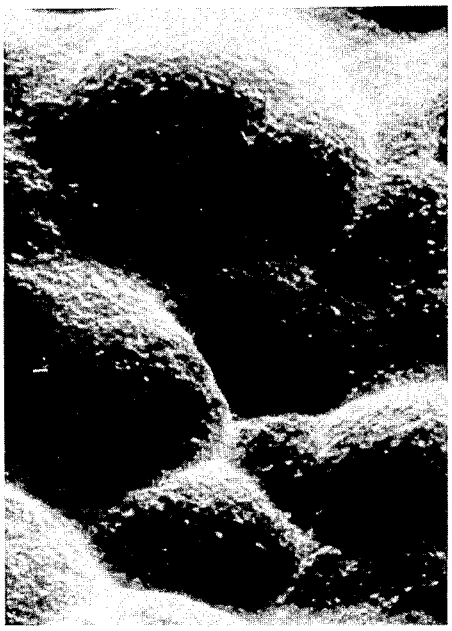
FIGS. 23 and 23*a* represent photomicrographs of the surface of a roller which has been sand blasted with sand abrasive No. 180 and then plated with chromium to a depth of between about 20μ to 25μ at magnifications of 1500 and 500, respectively.
Figure 23A:
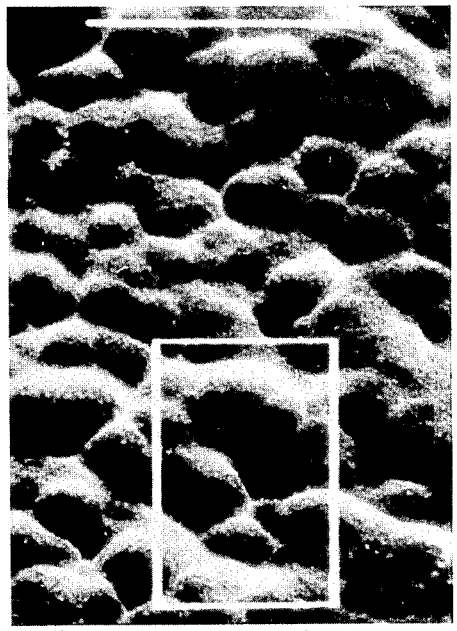
Figure 24:
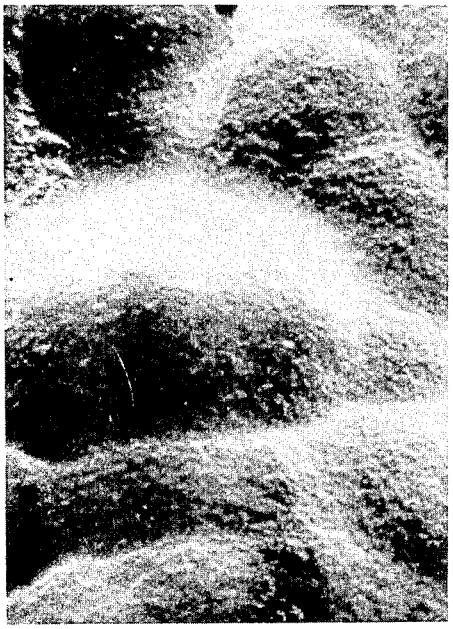
FIGS. 24 and 24*a* represent photomicrographs of the surface of a roller which has been sand blasted with sand abrasive No. 120; and then plated with chromium to a depth of between about 20μ to 25μ at magnifications of 1500 and 500, respectively.
Figure 24A:
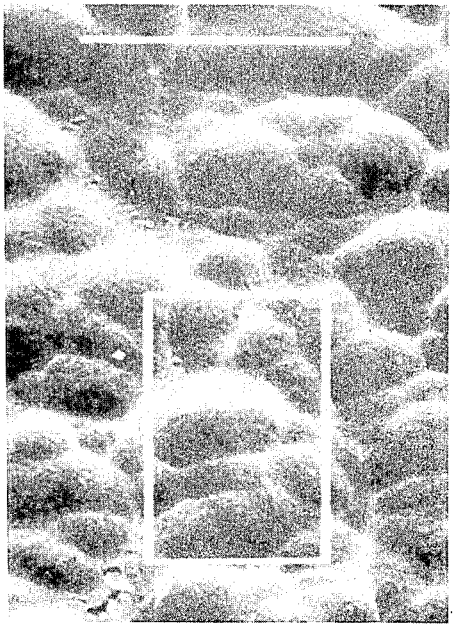
Figure 25:
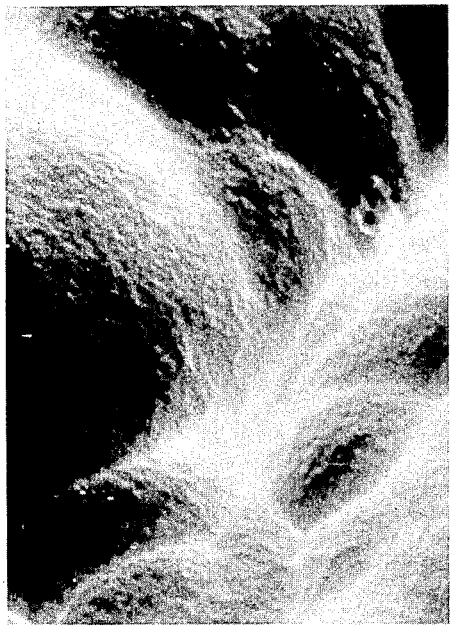
FIGS. 25 and 25*a* represent photomicrographs of the surface of a roller which has been sand blasted with sand abrasive No. 60 and then plated with chromium to a depth of between about 20μ to 25μ at magnifications of 1500 and 500, respectively.
Figure 25A:
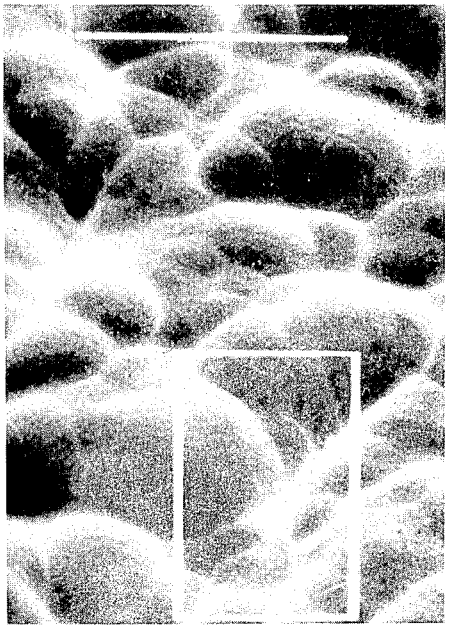

FIGS. 14–25 represent photomicrographs of the surfaces of rollers which have been either solely sand blasted with sand abrasives Nos. 500 to 60 (FIGS. 14–19) or both sand blasted with sand abrasives Nos. 500 to 60 and also chromium plated to a thickness of between about 20μ and 25μ. FIGS. 14–20 and 25 depict roller surfaces which are not produced in accordance with the present invention: FIGS. 14–19 show roller surfaces which have no leveling coating (chromium plating) at all, FIG. 20 shows a roller surface which, although including a leveling coating, has been sand blasted with a sand abrasive No. 500 and thus the projections thereon are too small and the produced gloss value too large (48%), and FIG. 25 shows a roller surface which, although including a leveling coating, has been sand blasted with a sand abrasive No. 60 and thus the projections thereon are too big and the fixing of toner images on a copying paper is difficult. FIGS. 21 and 24 show roller surfaces which not only have a leveling coating according to the present invention, but have been previously sand blasted with sand abrasives at the limits contemplated within the scope of the present invention. FIGS. 22 and 23 show roller surfacss which have been produced according to the best mode of the present invention, i.e., they not only have a leveling coating of chromium, but they have been previously sand blasted with sand abrasive Numbers 320 and 180, respectively. These FIGS. 22 and 23 represent the type of roller surfaces utilized in the preceeding Example.

According to the present invention, the roller to be brought into contact with unfixed toner images is rough-surfaced with minute round-edged projections formed thereon, so that the minute projections are impressed on the copy surface bearing toner images, thus imparting a glossless, dull and agreeable appearance to the toner images as well as to the background. Moreover, since the minute projections are round-edged, the copies obtained are neat and free from any offset at all times. Because there is no need to use a special additional device for eliminating the gloss which would usually result from the pressure fixing operation, the present apparatus is extremely simple in construction and inexpensive to make, needs no heater, and has every advantage of the pressure fixing system.

We claim:

1. In a copying apparatus which includes a photoconductive member, a charging means for charging the surface of the photoconductive member, means for exposing the charged surface of the photoconductive member to a light image of an original so as to form an electrostatic latent image on the surface of the photoconductive member, means for developing the electrostatic latent image on the surface of the photoconductive member into the form of toner images on a copying paper, and a fixing means for fixing the toner images on copying paper by pressure the improvement wherein said fixing means comprises a pair of rotatable metallic rollers forming a pressure nip therebetween through which the copying paper with toner images on one side passes, the metallic roller contacting the side of the copying paper on which the toner images are located having a roughened surface of minute round-edged projections, said surface comprising a leveling layer of chromium covering a sub-surface of roughened projections formed by sand blasting the metallic roller surface with abrasive particles having sizes in the range of No. 120 to No. 400; wherein means are connected to said pair of rotatable metallic rollers to apply a pressure of between 20 and 60 Kg/cm therebetween; and wherein means are provided for maintaining a clearance between said rollers a distance less than the thickness of the copying paper passing therebetween.

2. A pressure fixing apparatus as claimed in claim 1, wherein said leveling layer of chromium has a thickness of 5μ to 50μ.

3. A copying apparatus as claimed in claim 1, wherein said means for maintaining a clearance between said rollers comprises diametrically enlarged portions at opposite ends of one of said pair of rollers.

4. A copying apparatus as claimed in claim 3, further including means for applying a lubricant to said diametrically enlarged portions.

5. A copying apparatus as claimed in claim 4, wherein said pressure rollers have the grooves for preventing the lubricant from flowing over the surface of the pressure roller.

6. A copying apparatus as claimed in claim 1, further including means for cleaning the surface of the roughened roller surface.

* * * * *

UNITED STATES PATENT OFFICE

CERTIFICATE OF CORRECTION

PATENT NO. : 4,200,389

DATED : April 29, 1980

INVENTOR(S) : Toshio Matsui et al

It is certified that error appears in the above-identified patent and that said Letters Patent are hereby corrected as shown below:

[30] Foreign Application Priority Data

December 29, 1977 [JP] Japan.....52-160026

Signed and Sealed this

*Seventeenth* Day of *February 1981*

[SEAL]

*Attest:*

RENE D. TEGTMEYER

*Attesting Officer*

*Acting Commissioner of Patents and Trademarks*